US008511463B2

(12) United States Patent
Brand

(10) Patent No.: US 8,511,463 B2
(45) Date of Patent: Aug. 20, 2013

(54) CARTON WITH HANDLE

(75) Inventor: Kirsten L. Brand, Marietta, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 269 days.

(21) Appl. No.: 12/871,061

(22) Filed: Aug. 30, 2010

(65) Prior Publication Data

US 2011/0048975 A1 Mar. 3, 2011

Related U.S. Application Data

(60) Provisional application No. 61/237,837, filed on Aug. 28, 2009.

(51) Int. Cl.
*B65D 75/00* (2006.01)
*B31B 1/26* (2006.01)

(52) U.S. Cl.
USPC ..... 206/180; 206/167; 206/170; 229/117.12; 493/162

(58) Field of Classification Search
USPC ..... 206/167, 169, 170, 175, 180–187, 206/190–193, 196, 427, 141; 229/117.14, 229/120.09, 120.11, 117.09, 117.12; 493/162, 493/183
See application file for complete search history.

(56) References Cited

U.S. PATENT DOCUMENTS

| | | | | |
|---|---|---|---|---|
| 2,225,822 | A | | 12/1940 | Crook |
| 2,227,330 | A | | 12/1940 | Turner |
| 2,331,312 | A | | 10/1943 | Dorfman |
| 2,336,857 | A | | 12/1943 | Gies et al. |
| 2,689,061 | A | | 9/1954 | Gray |
| 2,721,001 | A | | 10/1955 | Hasselhoff |
| 2,776,072 | A | | 1/1957 | Forrer |
| 2,783,916 | A | | 3/1957 | Hodapp |
| 3,053,411 | A | | 9/1962 | Struble et al. |
| 3,190,487 | A | | 6/1965 | Wood |
| 3,191,800 | A | | 6/1965 | Kowal |
| 3,194,478 | A | | 7/1965 | Weiss |
| 3,236,414 | A | | 2/1966 | Slavin, Jr. |
| 3,268,113 | A | * | 8/1966 | Schuster ..... 206/187 |
| 3,313,466 | A | | 4/1967 | Keith |
| 3,343,742 | A | | 9/1967 | Siegler |
| 3,432,073 | A | | 3/1969 | Forrer |

(Continued)

FOREIGN PATENT DOCUMENTS

| | | |
|---|---|---|
| DE | 9004439 U1 | 6/1990 |
| EP | 1319607 | 6/2003 |
| WO | WO97/05026 | 2/1997 |
| WO | WO2006020525 | 2/2006 |

*Primary Examiner* — Luan K Bui
(74) *Attorney, Agent, or Firm* — Womble Carlyle Sandridge & Rice, LLP

(57) ABSTRACT

A carrier for holding a plurality of containers. The carrier comprises a plurality of panels that extend at least partially around an interior of the carrier. The panels comprise at least one bottom panel, a first side panel, a second side panel, and at least two end panels. The carrier comprises at least one divider flap comprising a longitudinal segment foldably connected to at least the first side wall or the second side wall, at least one transverse segment foldably connected to the first longitudinal segment, and at least one end segment foldably connected to the at least one transverse segment. A central divider wall divides the interior of the carrier into a front portion and a rear portion. The central divider wall comprises at least the at least one end segment of the at least one divider flap. A handle is attached to the central divider wall.

51 Claims, 10 Drawing Sheets

(56) References Cited

U.S. PATENT DOCUMENTS

| | | | | | |
|---|---|---|---|---|---|
| 3,669,306 | A | | 6/1972 | Forrer | |
| 3,672,539 | A | | 6/1972 | Forrer | |
| 3,721,335 | A | | 3/1973 | Grant | |
| 3,754,680 | A | | 8/1973 | Wood | |
| 3,784,053 | A | | 1/1974 | Stout | |
| 3,794,210 | A | * | 2/1974 | Stout | 206/173 |
| 3,917,058 | A | * | 11/1975 | Wood | 206/181 |
| 3,917,061 | A | | 11/1975 | Stout | |
| 3,924,740 | A | * | 12/1975 | Wood | 206/187 |
| 4,000,813 | A | | 1/1977 | Stout | |
| 4,000,814 | A | * | 1/1977 | Stout | 206/187 |
| 4,153,158 | A | | 5/1979 | Graser et al. | |
| 4,171,046 | A | | 10/1979 | Bonczyk | |
| 4,205,748 | A | | 6/1980 | Wilson | |
| 4,217,983 | A | | 8/1980 | Stout | |
| 4,243,138 | A | | 1/1981 | Wilson | |
| 4,253,564 | A | | 3/1981 | Engdahl, Jr. | |
| 4,308,950 | A | | 1/1982 | Wood | |
| 4,319,682 | A | | 3/1982 | Wright et al. | |
| 4,362,240 | A | | 12/1982 | Elward | |
| 4,450,956 | A | | 5/1984 | Wood | |
| 4,480,746 | A | | 11/1984 | Wood | |
| 4,544,092 | A | | 10/1985 | Palmer | |
| 4,591,090 | A | | 5/1986 | Collins et al. | |
| 4,722,437 | A | * | 2/1988 | Walsh | 206/170 |
| 4,770,294 | A | | 9/1988 | Graser | |
| 4,782,944 | A | * | 11/1988 | Engdahl, Jr. | 206/185 |
| 4,792,038 | A | | 12/1988 | Cooper | |
| 5,029,698 | A | * | 7/1991 | Stout | 206/188 |
| 5,040,672 | A | * | 8/1991 | DeMaio et al. | 206/162 |
| 5,191,976 | A | | 3/1993 | Stout et al. | |
| 5,458,234 | A | | 10/1995 | Harris | |
| 5,499,712 | A | | 3/1996 | Harrelson | |
| 5,531,319 | A | | 7/1996 | Harrelson | |
| 5,538,130 | A | | 7/1996 | Harrelson | |
| 5,538,131 | A | | 7/1996 | Harrelson | |
| 5,590,762 | A | | 1/1997 | Harrelson | |
| 5,593,027 | A | | 1/1997 | Sutherland | |
| 5,649,620 | A | | 7/1997 | Harrelson | |
| 5,657,864 | A | | 8/1997 | Harrelson | |
| 5,657,865 | A | | 8/1997 | Harrelson | |
| 5,682,982 | A | | 11/1997 | Stonehouse | |
| 5,775,487 | A | | 7/1998 | Harrelson | |
| 5,878,877 | A | | 3/1999 | Sutherland | |
| 5,884,756 | A | | 3/1999 | Holley, Jr. et al. | |
| 5,947,273 | A | | 9/1999 | Dalrymple et al. | |
| 6,131,729 | A | | 10/2000 | Eckermann et al. | |
| 6,155,962 | A | | 12/2000 | Dalrymple et al. | |
| 6,247,585 | B1 | | 6/2001 | Holley, Jr. | |
| 6,341,689 | B1 | | 1/2002 | Jones | |
| 6,371,287 | B1 | | 4/2002 | Jones et al. | |
| 6,736,260 | B2 | | 5/2004 | Gomes et al. | |
| 6,938,756 | B2 | | 9/2005 | Schuster | |
| 7,455,174 | B2 | * | 11/2008 | Cuomo | 206/175 |
| 7,677,387 | B2 | | 3/2010 | Brand et al. | |
| 2005/0230273 | A1 | | 10/2005 | Kohler | |
| 2007/0071983 | A1 | | 3/2007 | Brand et al. | |
| 2009/0008273 | A1 | | 1/2009 | Smalley | |

* cited by examiner

CARTON WITH HANDLE

CROSS-REFERENCE TO RELATED APPLICATIONS

This application claims the benefit of U.S. Provisional Patent Application No. 61/237,837, filed Aug. 28, 2009.

INCORPORATION BY REFERENCE

U.S. Provisional Patent Application No. 61/237,837, which was filed on Aug. 28, 2009, is hereby incorporated by reference for all purposes as if presented herein in its entirety.

BACKGROUND OF THE DISCLOSURE

The present disclosure relates to a carton for holding a plurality of containers. More specifically, the present disclosure relates to a basket-type carton having a handle and a plurality of container compartments for holding containers in two or more rows.

SUMMARY OF THE DISCLOSURE

The present disclosure is generally related to a carton for holding a plurality of containers. More specifically, the disclosure relates to such a carton that provides improved protection of containers contained in the carton and improved structural integrity, while keeping the weight of the carton low.

In general, one aspect of the disclosure is directed to a carrier for holding a plurality of containers. The carrier comprises a plurality of panels that extend at least partially around an interior of the carrier. The plurality of panels comprises at least one bottom panel, a first side panel, a second side panel, and at least two end panels. The carrier comprises at least one divider flap comprising a longitudinal segment foldably connected to at least the first side wall or the second side wall, at least one transverse segment foldably connected to the first longitudinal segment, and at least one end segment foldably connected to the at least one transverse segment. A central divider wall divides the interior of the carrier into a front portion and a rear portion. The central divider wall comprises at least the at least one end segment of the at least one divider flap. A handle is attached to the central divider wall.

In another aspect, the disclosure is generally directed to a blank for forming a carrier for holding a plurality of containers. The blank comprises a plurality of panels comprising at least one bottom panel, a first side panel, a second side panel, and at least two end panels and at least one divider flap comprising a longitudinal segment foldably connected to at least the first side wall or the second side wall, at least one transverse segment foldably connected to the first longitudinal segment, and at least one end segment foldably connected to the at least one transverse segment. The blank comprises a handle comprising at least one handle flap at least partially defined by a cut line extending between the at least one handle flap and at least a portion of the at least one divider flap. The at least one end segment of the at least one divider flap is for forming at least a portion of a central divider wall for dividing the interior of the carrier formed from the blank into a front portion and a rear portion.

In another aspect, the disclosure is generally directed to a method of forming a carton. The method comprises obtaining a blank comprising a plurality of panels comprising at least one bottom panel, a first side panel, a second side panel, and at least two end panels, at least one divider flap comprising a longitudinal segment foldably connected to at least the first side wall or the second side wall, at least one transverse segment foldably connected to the first longitudinal segment, and at least one end segment foldably connected to the at least one transverse segment, and a handle. The method comprising folding the at least one divider flap to be at least partially in face-to-face contact with at least a portion of at least the first side panel or the second side panel and folding the blank along a longitudinal centerline so that the at least one end segment of the at least one divider flap is disposed between the first side wall and the second side wall. The at least one end segment forms at least a portion of a central divider wall. The method comprises forming an interior of the carrier by extending the at least two end panels away from the central divider wall so that the interior of the carrier is divided into a front portion and a rear portion by the central divider wall. The forming the interior of the carrier causes the at least one transverse segment of the at least one divider flap to pivot with respect to the longitudinal segment and the at least one end segment so that the at least one transverse segment extends generally perpendicularly to the central divider wall and extends at least partially to the first side panel or the second side panel.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure generally relates to constructs, packages, cartons, or the like, and packages for holding and displaying containers C (FIG. 15) such as bottles, jars, cans, etc. The containers can be used for packaging food and beverage products, for example. The containers can be made from materials suitable in composition for packaging the particular food or beverage item, and the materials include, but are not limited to, aluminum and/or other metals, plastics such as PET, LDPE, LLDPE, HDPE, PP, PS, PVC, EVOH, and Nylon; and the like; glass; or any combination thereof.

Packages according to the present disclosure can accommodate containers of numerous different shapes. For the purpose of illustration and not for the purpose of limiting the scope of the disclosure, the following detailed description uses the example of beverage containers (e.g., generally plastic or glass bottles) at least partially disposed within the package. In this specification, the terms "side," "end," "bottom," and "top", indicate orientations determined in relation to fully erected cartons. The terms "lateral" and "longitudinal" are employed to describe the relative orientations of lines and other features, and it should be understood that these orientations can be reversed.

Figure 1:
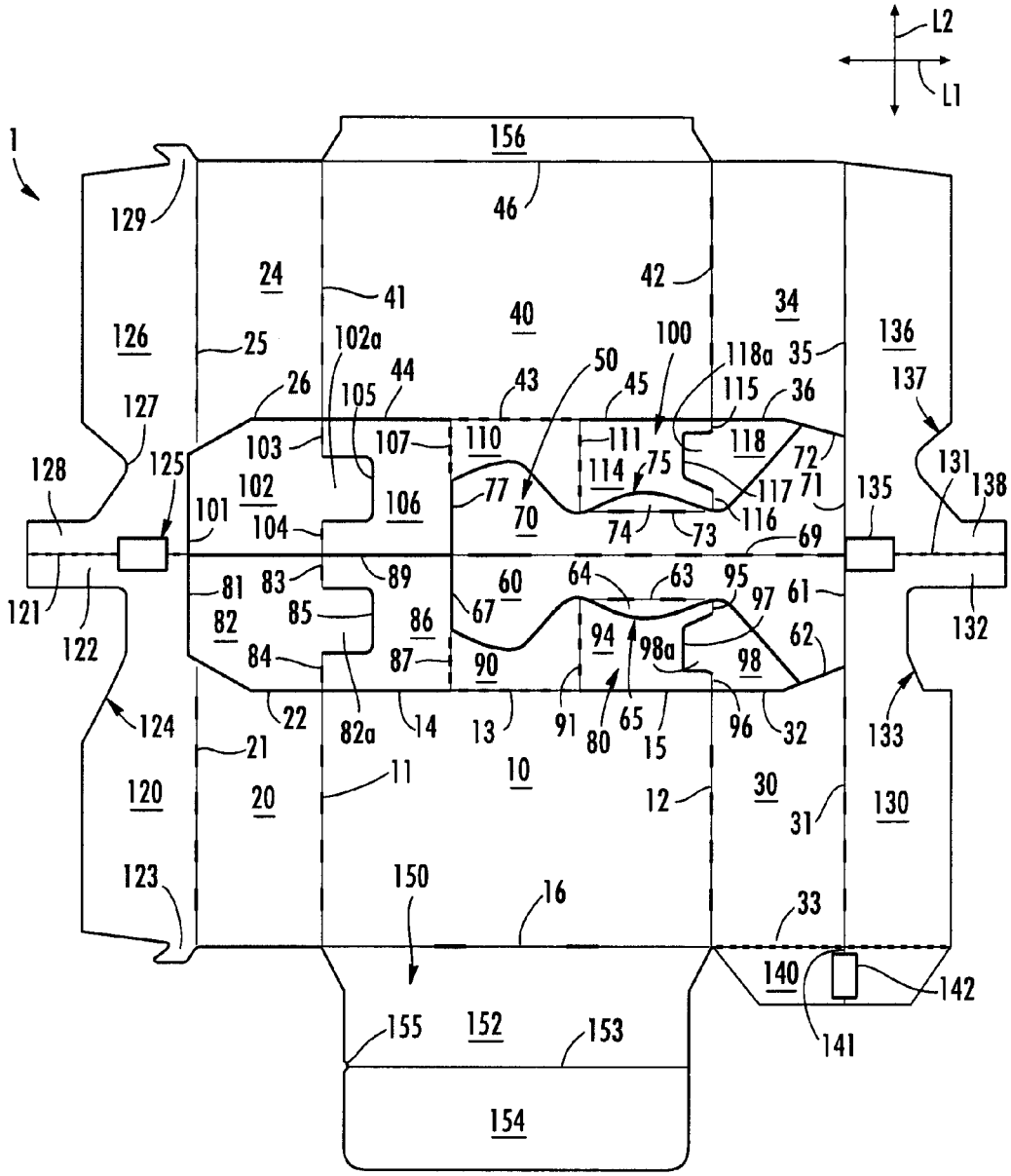
FIG. 1 is an exterior plan view of a carrier blank in accordance with one aspect of the disclosure.

FIG. 1 shows a blank 1 for forming a carton or carrier 200 (FIGS. 8-11). The blank 1 has a longitudinal axis L1 and a lateral or transverse axis L2. The blank 1 includes a first side panel 10, a first end panel 20 foldably connected to a first lateral edge of the first side panel 10 at a lateral fold line 11, and a second end panel 30 foldably connected to a second lateral edge of the first side panel 10 at a lateral fold line 12.

The blank 1 includes second side panel 40, a third end panel 24, and a fourth end panel 34 laterally opposite of, and laterally spaced from the first side panel 10, the first end panel 20 and the second end panel 30, respectively. The third end panel 24 is foldably connected to a first lateral edge of the second side panel 40 at a lateral fold line 41, and the fourth end panel 34 is foldably connected to a second lateral edge of the fourth end panel 34 at a lateral fold line 42.

As shown in FIG. 1, a first end closure flap 120 is foldably connected to the first end panel 20 at a lateral fold line 21. A second end closure flap 130 is foldably connected to the second end panel 30 at a lateral fold line 31. A third end closure flap 126, positioned laterally opposite of the first end closure flap 120, is foldably connected to the third end panel 24 at a lateral fold line 25 and is foldably connected to the first end closure flap 120 at a longitudinal fold line 121. A fourth end closure flap 136, positioned laterally opposite of the second end closure flap 130, is foldably connected to the fourth end panel 34 at a lateral fold line 35 and is foldably connected to the second end closure flap 130 at a longitudinal fold line 131.

In the illustrated embodiment, the first end closure flap 120 and the third end closure flap 126 include longitudinally protruding portions 122, 128 positioned adjacent each other and joined together at the fold line 121. Cut-away portions 124, 127 are formed adjacent the protruding portions 122, 128, respectively. Respective locking tabs or hooks 123, 129 extend from longitudinal free edges of the first and third end closure flaps 120, 126. The second end closure flap 130 and the fourth end closure flap 136 include longitudinally protruding portions 132, 138 positioned adjacent each other and joined together at the fold line 131. Cut-away portions 133, 137 are formed adjacent the protruding portions 132, 138, respectively.

A rectangular opening 125 can be provided in the first and third end closure flaps 120, 126, and intersects the fold lines 21, 25, 121 to facilitate folding of the end first and third end closure flaps 120, 126. Similarly, a rectangular opening 135 is provided in the second and fourth end closure flaps 130, 136, and intersects the fold lines 31, 35, 131 to facilitate folding of the second and fourth end closure flaps 130, 136.

According to the illustrated embodiment, a first divider flap 80 extends longitudinally adjacent the first side panel 10, the first end panel 20 and the second end panel 30. The first divider flap 80 includes a first divider flap segment 82, a second divider flap segment 86 foldably connected to the first divider flap segment 82, a third divider flap segment 90 foldably connected to the second divider flap segment 86 and the first side panel 10, a fourth divider flap segment 94 foldably connected to the third divider flap segment 90, and a fifth divider flap segment 98 foldably connected to the fourth divider flap segment 94.

The first divider flap segment 82 forms an end segment in the divider flap 80 and is positioned adjacent the first end closure flap 120 and the first end panel 20. The first divider flap segment 82 has a first lateral edge separated from the first end closure flap 120 at a laterally-extending cut line 81, and a first longitudinal edge separated from the first end panel 20 at a cut line 22 having a longitudinal portion and an oblique portion. A second lateral edge of the first divider flap segment 82 is defined by laterally spaced apart, lateral fold lines 83, 84 and a substantially U-shaped cut 85 extending between endpoints of the fold lines 83, 84. The substantially U-shaped cut 85 defines a tab 82*a* of the first divider flap segment 82.

The second divider flap segment 86 forms a transverse segment in the erected carrier 200 and is positioned adjacent the first side panel 10 and separated from the first side panel 10 at a longitudinally-extending cut line 14. A first lateral edge of the second divider flap segment 86 is defined by the lateral fold lines 83, 84 and the substantially U-shaped cut 85. The second divider flap segment 86 is foldably connected to the first divider flap segment 82 at the lateral fold lines 83, 84, and is partially separated from the first divider flap segment 82 at the substantially U-shaped cut line 85. A lateral fold line 87 extends along a portion of a second lateral edge of the second divider flap segment 86.

The third divider flap segment 90 forms a longitudinal segment of the divider flap 80 and is foldably connected to the first side panel 10 at a longitudinal fold line 13, which defines a first longitudinal edge of the third divider flap segment 90. The third divider flap segment 90 is foldably connected to the second divider flap segment 82 at the lateral fold line 87, which defines a first lateral edge of the third divider flap segment 90. A second lateral edge of the third divider flap segment 90 is defined by a lateral fold line 91.

The fourth divider flap segment 94 forms a transverse segment in the erected carrier 200 and is positioned adjacent the first side panel 10 and is foldably connected to the third divider flap segment 90 at the lateral fold line 91. The fold line 91 defines a first lateral edge of the fourth divider flap segment 94. The fourth divider flap segment 94 has a first longitudinal edge separated from the first side panel 10 at a longitudinally-extending cut line 15. A second lateral edge of the fourth divider flap segment 94 is defined by laterally spaced apart, lateral fold lines 95, 96 and a substantially U-shaped cut 97 extending between endpoints of the fold lines 95, 96.

The fifth divider flap segment 98 forms an end segment in the divider flap 80 and is foldably connected to the fourth divider flap segment 94 at the lateral fold lines 95, 96, and is partially separated from the fourth divider flap segment 94 at the substantially U-shaped cut 97. The fifth divider flap segment 98 is further defined by cut line 32 extending between the fifth divider flap segment and the second end panel 30. The substantially U-shaped cut 97 defines a tab 98*a* of the fifth divider flap segment 98.

As shown in FIG. 1, a second divider flap 100, which is similar in configuration to the first divider flap 80, extends longitudinally adjacent the second side panel 40, the third end panel 24 and the fourth end panel 34. The second divider flap 100 includes a sixth divider flap segment 102, a seventh divider flap segment 106 foldably connected to the sixth divider flap segment 102, an eighth divider flap segment 110 foldably connected to the seventh divider flap segment 106 and the second side panel 40, a ninth divider flap segment 114 foldably connected to the eighth divider flap segment 110, and a tenth divider flap segment 118 foldably connected to the ninth divider flap segment 114.

The sixth divider flap segment 102 forms an end segment in the divider flap 100 and is positioned adjacent the third end closure flap 126 and the third end panel 24. The sixth divider flap segment 102 has a first lateral edge separated from the third end closure flap 126 at a laterally-extending cut line 101, and a first longitudinal edge separated from the third end panel 24 at a cut line 26 having a longitudinal portion and an oblique portion. A second lateral edge of the first divider flap segment 102 is defined by laterally spaced apart, lateral fold lines 103, 104 and a substantially U-shaped cut 105 extending between endpoints of the fold lines 103, 104. The substantially U-shaped cut 105 defines a tab 102*a* of the sixth divider flap segment 102.

The seventh divider flap segment 106 forms a transverse segment in the erected carrier 200 and is positioned adjacent the second side panel 40 and separated from the second side panel 40 at a longitudinally-extending cut line 44. The lateral fold lines 103, 104 and the substantially U-shaped cut 105 define a first lateral edge of the seventh divider flap segment 106. The seventh divider flap segment 106 is foldably connected to the sixth divider flap segment 102 at the lateral fold lines 103, 104, and is partially separated from the sixth divider flap segment 102 at the substantially U-shaped cut line 105. A lateral fold line 107 extends along a portion of a second lateral edge of the seventh divider flap segment 106.

The eighth divider flap segment 110 forms a longitudinal segment of the divider flap 100 and is foldably connected to the second side panel 40 at a longitudinal fold line 43, which defines a first longitudinal edge of the eighth divider flap segment 110. The eighth divider flap segment 110 has a first lateral edge defined by the lateral fold line 107. The eighth divider flap segment 110 is therefore foldably connected to the seventh divider flap segment 102 at the lateral fold line 107. The eighth divider flap segment 110 is foldably connected to the second side panel 40 at a longitudinal fold line 43, which defines a first longitudinal edge of the eighth divider flap segment 110. A lateral fold line 111 defines a second lateral edge of the eighth divider flap segment 110.

The ninth divider flap segment 114 forms a transverse segment in the erected carrier 200 and is positioned adjacent the second side panel 40. A first lateral edge of the ninth divider flap segment 114 is defined by the lateral fold line 111, where the ninth divider flap segment 114 is foldably connected to the eighth divider flap segment 110. The ninth divider flap segment 114 has a first longitudinal edge separated from the second side panel 40 at a longitudinally-extending cut line 45. A second lateral edge of the ninth divider flap segment 114 is defined by laterally spaced apart, lateral fold lines 115, 116 and a substantially U-shaped cut 117 extending between endpoints of the fold lines 115, 116.

The tenth divider flap segment 118 forms an end segment in the divider flap 100 is foldably connected to the ninth divider flap segment 114 at the lateral fold lines 115, 116, and is partially separated from the ninth divider flap segment 114 at the substantially U-shaped cut 117. The tenth divider flap segment 118 is further defined by cut line 36 extending between the tenth divider flap segment and the fourth end panel 34. The substantially U-shaped cut 117 defines a tab 118*a* of the tenth divider flap segment 118.

The first and second divider flap segments 82, 86 can be positioned adjacent the sixth and seventh divider flap segments 102, 106, respectively. A longitudinal gap 89 extends between the first and sixth divider flap sections, 82, 102 and the second and fourth divider flap segments 86, 106.

As shown in FIG. 1, a handle flap 50 is foldably connected to the second and fourth end closure flaps 130, 136 and extends longitudinally between the second and fourth end panels 30, 36 and between the first and second divider flaps 80, 100. The handle flap 50 includes a first handle flap section 60 and a second handle flap section 70. The first handle flap section 60 is positioned adjacent the first divider flap 80, the second end panel 30 and the second end closure flap 130. The first handle flap section 60 is foldably connected to the second end closure flap 130 at a lateral fold line 61 that is collinear with the lateral fold line 31. The second handle flap section 70 is foldably connected to the first flap section 60 at a longitudinal fold line 69 and is positioned adjacent the second divider flap 100, the fourth end panel 34 and the fourth end closure flap 136. The second handle flap section 70 is foldably connected to the fourth end closure flap 136 at a lateral fold line 71 that is collinear with the lateral fold line 35. The handle flap 50 further includes grip flaps 64, 74 that are foldably connected to longitudinal edges of the handle flap sections 60, 70, respectively, at longitudinal fold lines 63, 73. The grip flaps 64, 74 can be defined adjacent the fourth and ninth divider flap segments, 94, 114, respectively.

In the illustrated embodiment, the first and second handle flap sections 60, 70 are separated from the second and fourth end panels 30, 34 by a respective oblique cut line 62, 72. The first handle flap section 60 and the first grip flap 64 are separated from the third, fourth, and fifth divider flap segments 90, 94, 98 by an undulating gap or cut line 65 extending from the oblique gap 62. The second handle flap section 70 and the second grip flap 74 are separated from the eighth, ninth, and tenth divider flap segments 110, 114, 118 by an undulating gap or cut line 75 extending from the oblique gap 72. Lateral gaps or cut lines 67, 77, which can be collinear with the lateral fold lines 87, 107, separate the first and second handle flap sections 60, 70 from the second and seventh divider flap segments 86, 106, respectively.

The blank 1 can include an end reinforcement flap 140 foldably connected to longitudinal edges of the second end panel 30 and the second end closure flap 130 at a longitudinal fold line 33. The end reinforcement flap 140 includes a lateral fold line 141 and a rectangular opening 142 intersecting the fold line 141. The fold line 141 and the opening 142 are disposed at a longitudinally central region of the end reinforcement flap 140. The opening 140 facilitates folding of the end reinforcement flap 140 at the fold line 141. Although the opening 140 is shown as having a rectangular shape, other shapes are possible.

As shown in FIG. 1, the blank 1 includes a bottom flap 150, which has a first bottom flap section 152 and a second bottom flap section 154. The first bottom flap section 152 is foldably connected to the first side panel 10 at a longitudinal fold line 16. The second bottom flap section 154 is foldably connected to the first bottom flap section 152 at a longitudinal fold line 153. A V-shaped notch 155 is located at a first lateral edge of the bottom flap 150 in alignment with the fold line 153, and is configured to engage the locking tabs 123, 129, as will be described later.

A bottom closure flap 156 can be foldably connected to the second side panel 40 at a longitudinal fold line 46. The bottom closure flap 156 is configured to be attached to the bottom flap 150 to form a bottom wall 240 (FIG. 10) of the carrier 200, as will be described below.

Figure 2:
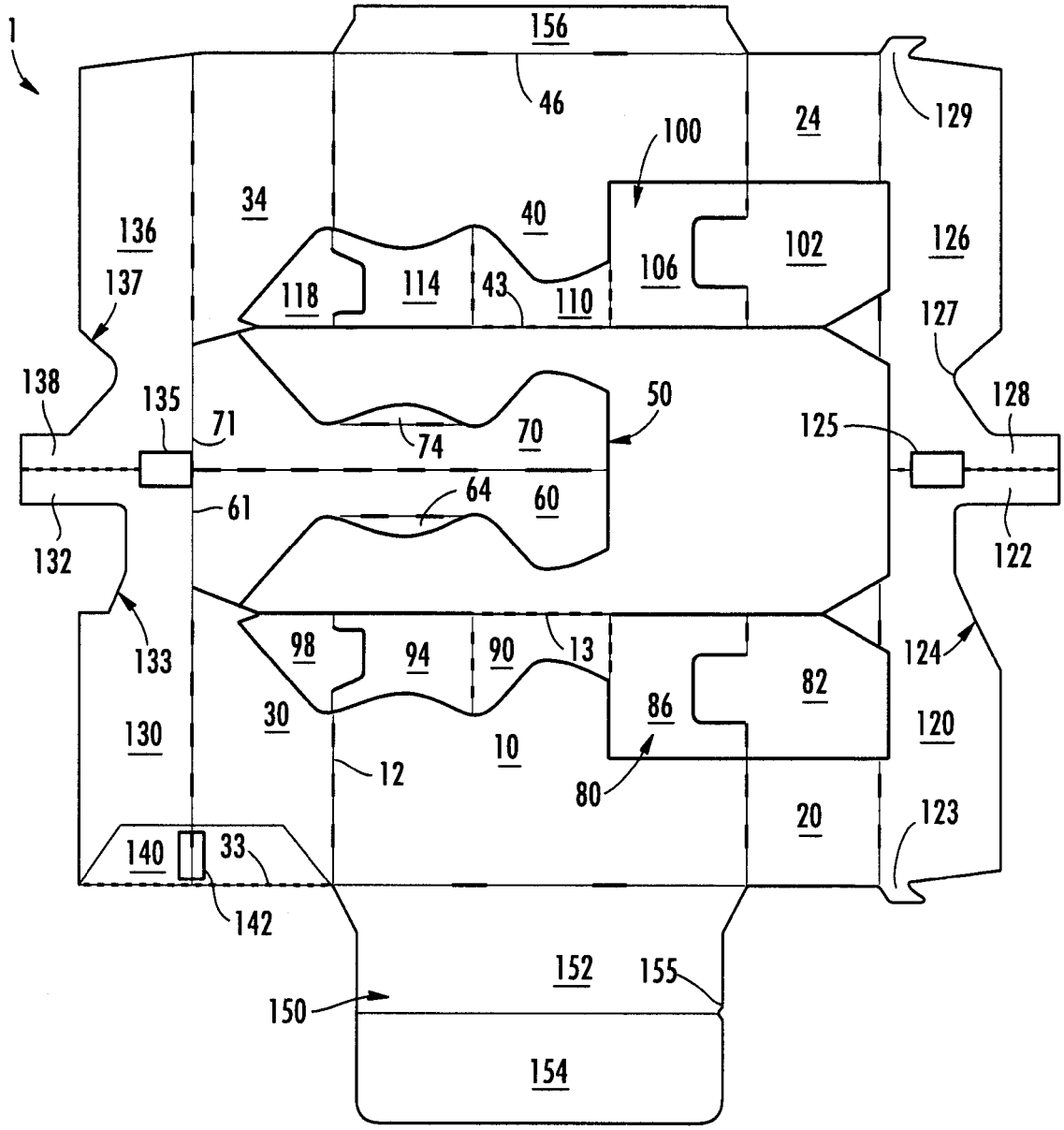
FIGS. 2-4 are plan views illustrating the folding of the blank to form a partially-erected carrier in accordance with one aspect of the disclosure.
Figure 3:
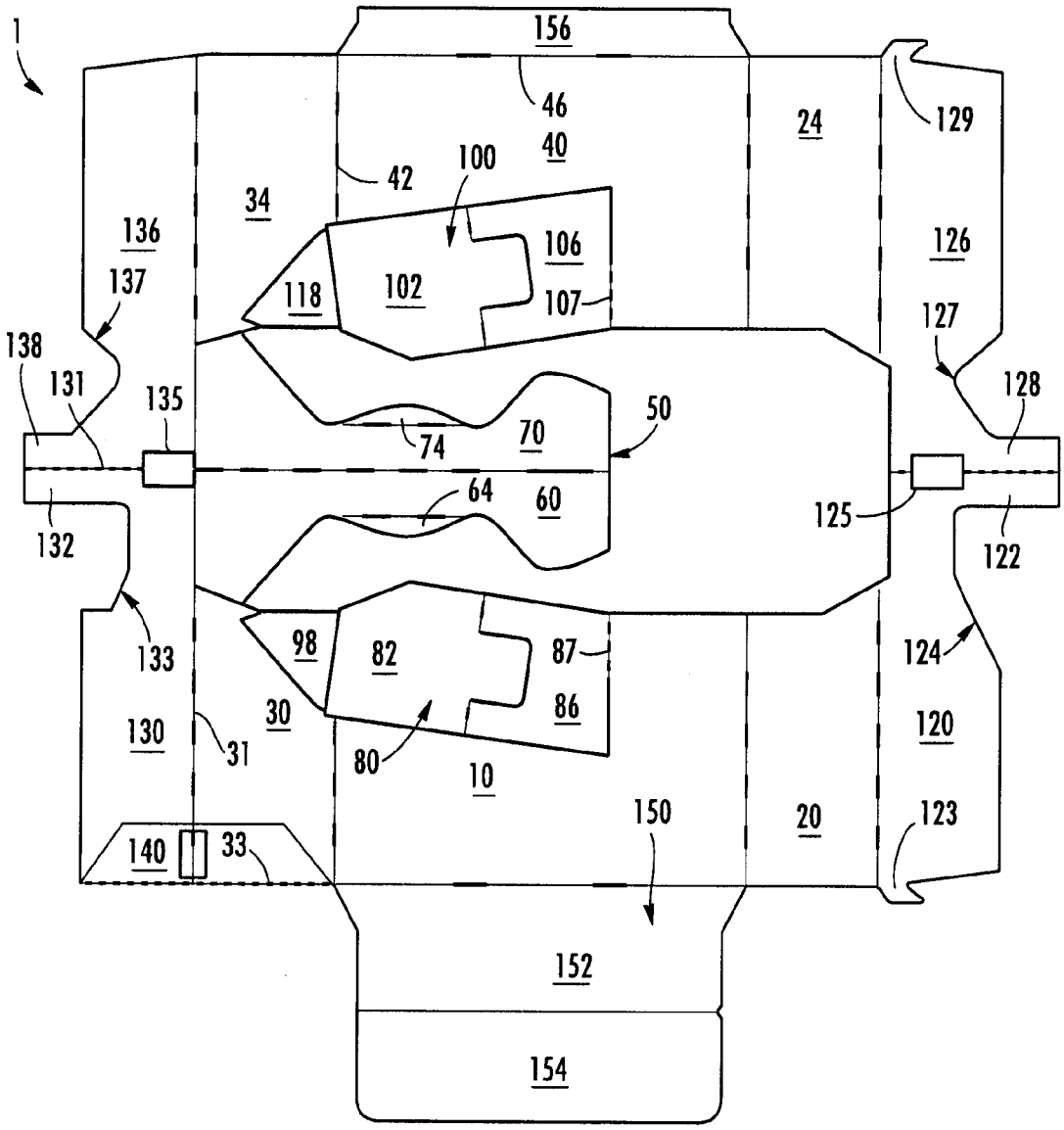

An exemplary process for erecting the carrier 200 from the blank 1 illustrated in to FIGS. 2-7. As shown in FIG. 2, in an exemplary initial step, the first divider flap 80 can be folded inwardly along the fold line 13 such that the first divider flap 80 partially overlaps the first side panel 10, the first end panel 20, the second end panel 30 and the first end closure flap 120, with the inner side of the first divider flap 80 facing the inner sides of the first side panel 10, the first end panel 20, the second end panel 30 and the first end closure flap 120. Similarly, the second divider flap 100 can be folded along the fold line 43 such that the second divider flap 100 partially overlaps the second side panel 40, the third end panel 24, the fourth end panel 34 and the third end closure flap 126, with the inner side of the second divider flap 100 facing the inner sides of the second side panel 40, the third end panel 24, the fourth end panel 34 and the third end closure flap 126. The third and eighth divider flap segments 90, 110 can be attached to the first and second side walls 10, 40, respectively, with adhesive or other attachment means. Also, as shown in FIG. 3, the end reinforcement flap 140 can be folded along the fold line 33 such that the end reinforcement flap 140 partially overlaps the second end panel 30 and the second end closure flap 130, and the inner side of the end reinforcement flap 140 faces the inner sides of the second end panel 30 and the second end closure flap 130. The end reinforcement flap 140 can be attached to the second end panel 30 and the second end closure flap 130 with adhesive or other attachment means.

In as subsequent step shown in FIG. 3, the first divider flap 80 can be folded along the fold line 87 such that the first and section divider flap segments 82, 86 overlap the third and fourth divider flap segments 90, 94 and partially overlap the fifth divider flap segment 98. In the this configuration, the outer sides of the first and second divider flap segments 82, 86 face the outer sides of the third, fourth and fifth divider flap segments 90, 94, 98. The second divider flap 100 can be folded in a similar manner along the fold line 107 such that the sixth and seventh divider flap segments 102, 106 overlap the eighth and ninth divider flap segments 110, 114 and partially overlap the tenth divider flap segment 118. In this configuration, the outer sides of the sixth and seventh divider flap segments 102, 106 face the outer sides of the eighth, ninth and tenth divider flap segments 110, 114, 118. The first divider flap segment 82 can be attached to the tab 98*a* of the fifth divider flap segment 98 with adhesive or other attachment means. The sixth divider flap segment can be attached to the tab 118*a* of the tenth divider flap segment 118 with adhesive or other attachment means.

Figure 4:
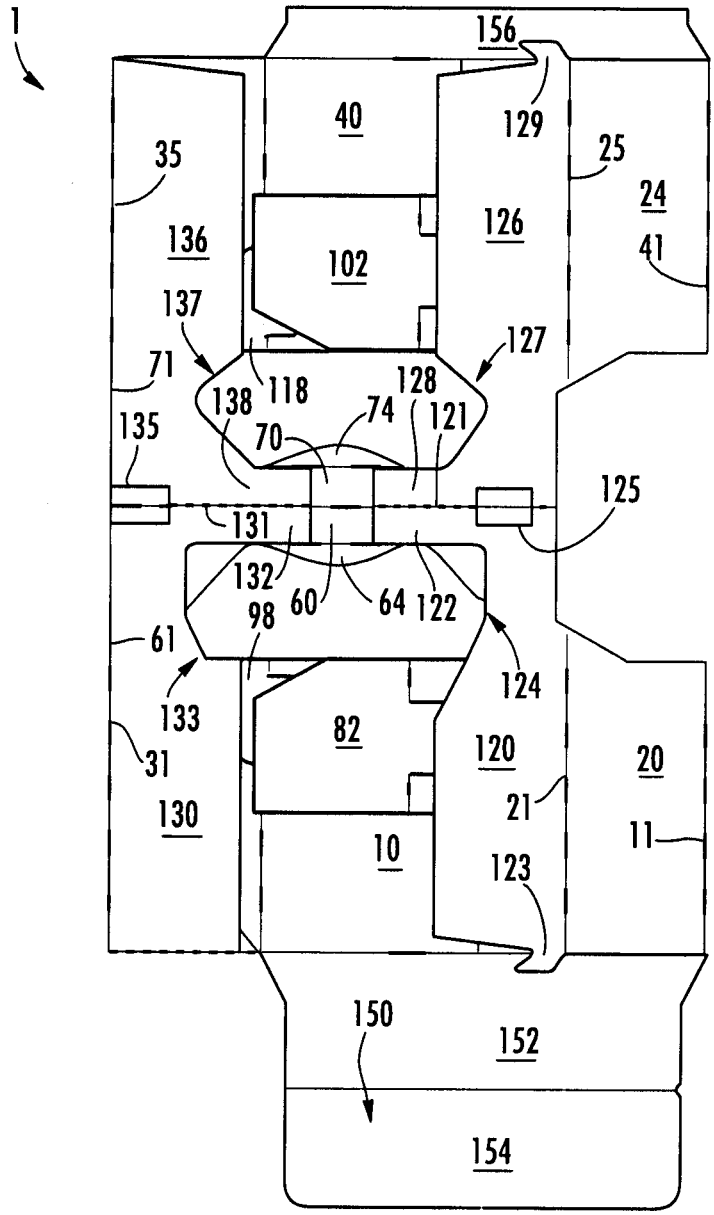

Next, with reference to FIG. 4, the blank 1 can be folded at the fold lines 11, 41 such that the first and third end panels 20, 24 partially overlap the first and second side panels 10, 40, respectively, with the inner sides of the first and third end panels 20, 24 facing the inner sides of the first and second side panels 10, 40. As a result, the first end closure flap 120 partially overlaps the first side panel 10, the first divider flap 80 and the first handle flap section 60, with the inner side of the first end closure flap 120 facing the inner side of the first side panel 10, and the third end closure flap 126 partially overlaps the second side panel 40, the second divider flap 100 and the second handle flap section 70, with the inner side of the third end closure flap 126 facing the inner side of the second side panel 40. Using adhesive or other attachment means, the first end closure flap 120 can be attached to the tab 82*a* of the first divider flap segment 82 and the third end closure flap 126 can be attached to the tab 102*a* of the sixth divider flap segment 102. Additionally, in this configuration, the longitudinal projections 122, 128 of the first and third end closure flaps 120, 126 partially overlap the first and second handle flap sections 60, 70, respectively, and the fold line 121 between the projections 122, 128 is aligned with the fold line 69 between the first and second handle flap sections 60, 70. The projections 122, 128 can be attached to the first and second handle flap segments 60, 70, respectively, with adhesive or other attachment means.

As illustrated in FIG. 4, either before, after, or simultaneously with folding the blank along fold lines 11, 41 as described above, the blank 1 can be folded along the fold lines 31, 35 such that the second and fourth end closure flaps 130, 136 partially overlap the second and fourth end panels 30, 34, respectively, and the fifth and tenth divider flap segments 98, 118, respectively, and the inner sides of the second and fourth end closure flaps 130, 136 face the inner sides of the second and fourth end panels 30, 34. Upon folding the blank 1 in this manner, the longitudinal projections 132, 138 of the second and fourth end closure flaps 130, 136 partially overlap the first and second handle flap sections 60, 70, respectively, and the fold line 131 between the projections 132, 138 is aligned with the fold line 69 between the first and second handle flap sections 60, 70. The projections 132, 138 can be attached to the first and second handle flap segments 60, 70, respectively, with adhesive or other attachment means. Additionally, the second and fourth end closure flaps 130, 136 can be attached to the fifth and tenth divider flap segments 98, 118, respectively, with adhesive or other attachment means.

Figure 5:
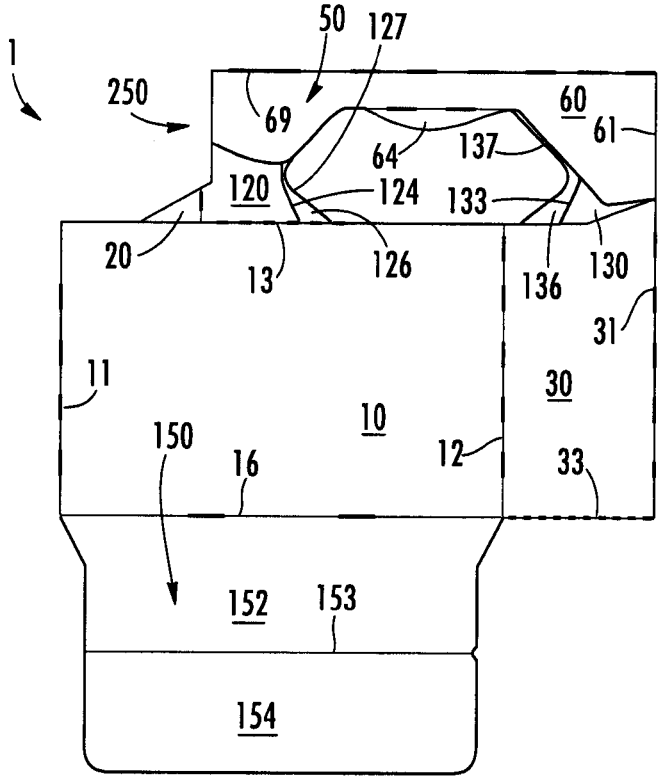
FIGS. 5 and 6 are plan views of the partially-erected carrier in a flattened state.
Figure 6:
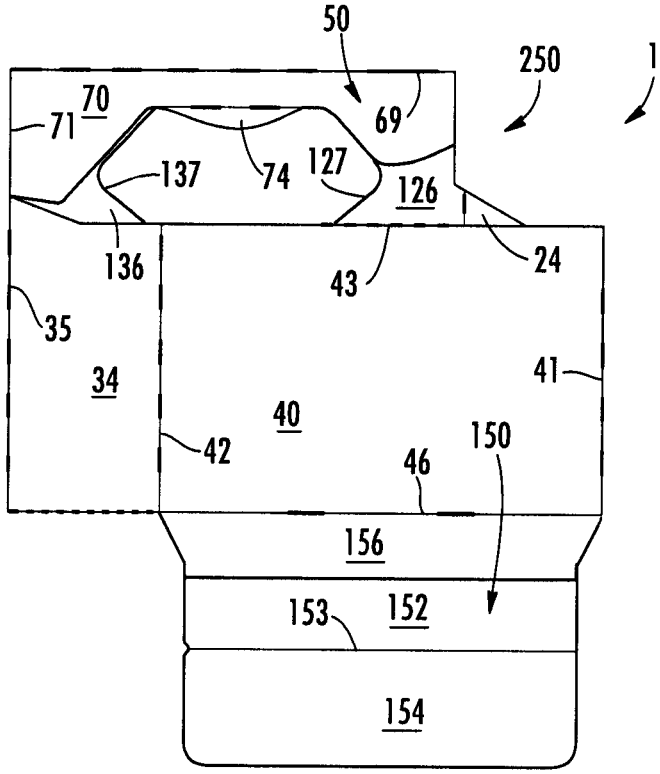

Next, as shown in FIGS. 5 and 6, the blank 1 can be folded along the fold lines 69, 121, 131 into a substantially flat structure having a first side on which the outer sides of the first side panel 10, the second end panel 30, the first handle flap section 60, the grip flap 64 and the bottom flap 150 are exposed, and a second side on which the inner side of the bottom flap 150 and the outer sides of the second side panel 40, the fourth end panel 34, the second handle flap section 70, the outer grip flap 74 and the bottom closure flap 156 are exposed.

In the configuration of FIGS. 5 and 6, the inner sides of the handle flap sections 60, 70 face each other, the outer sides of the projections 122, 132 face the outer sides of the projections 128, 138, respectively, the outer sides of the first and third end panels 20, 24 face each other, the outer sides of the first and third end closure flaps 120, 124 face each other, and the outer sides of the second and fourth end closure flaps 130, 136 face each other. The projections 122, 132 can be attached to the projections 128, 138, respectively, with adhesive or other attachment means. The first handle flap section 60 can be adhesively or otherwise attached to the first and second end closure flaps 120, 130, and the second handle flap section 70 can be adhesively or otherwise attached to the third and fourth end closure flaps 126, 136. Additionally, the first and second end closure flaps 120, 130 can be adhesively or otherwise attached to the third and fourth end closure flaps 126, 136, respectively. As a result, the first and second handle flap sections 60, 70 and the grip flaps 64, 74 form a handle 250 having a first end supported by the projections 122, 128 and the first and third end closure flaps 120, 126, and a second end supported by the projections 132, 138 and the second and fourth end closure flaps 130, 136.

Figure 7:
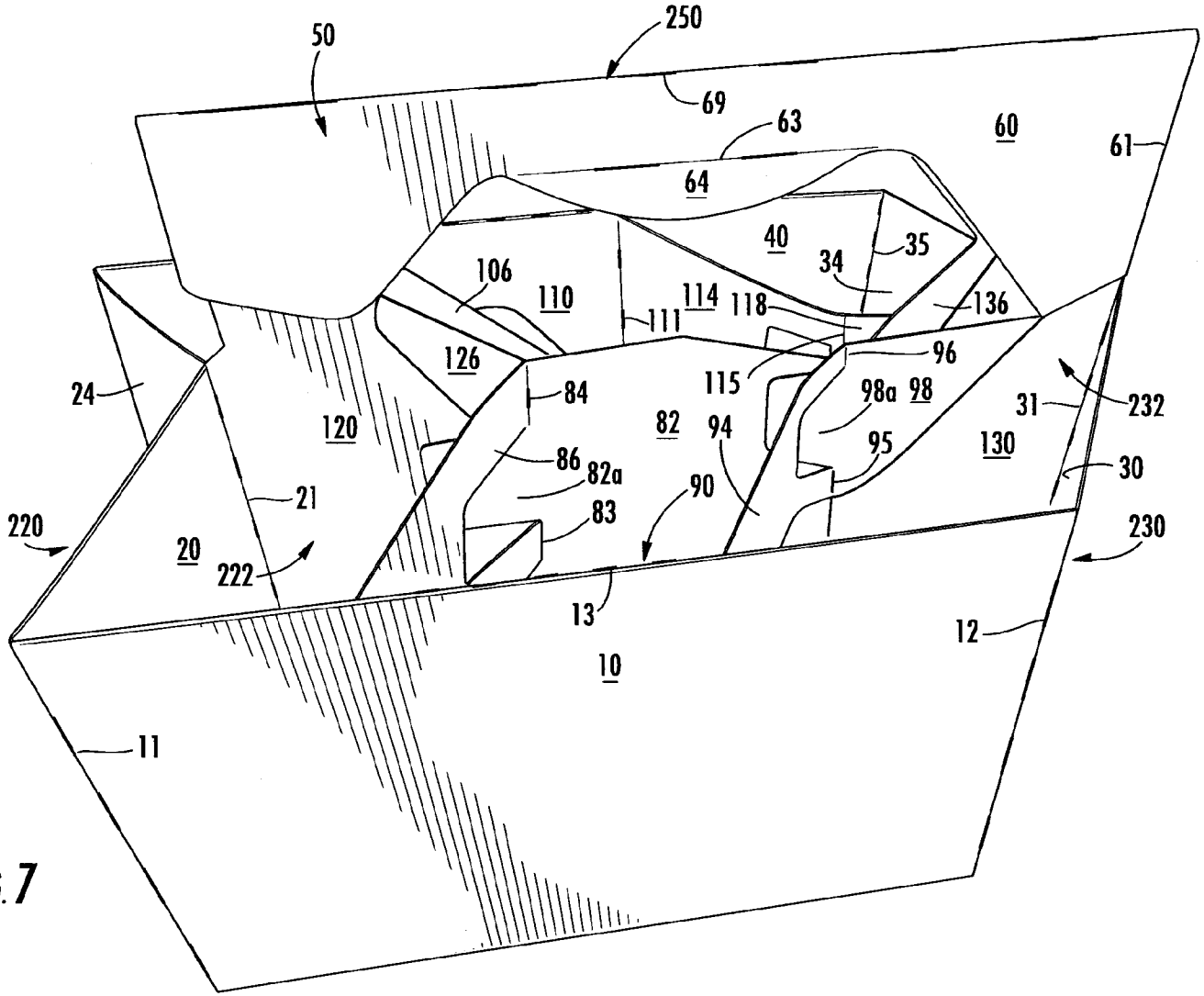
FIG. 7 is a perspective view showing the erection of the carrier from the flattened carrier of FIGS. 5 and 6.

Next, as illustrated in FIG. 7, the blank 1 can be folded along the fold lines 11, 12, 21, 31, 25, 35, 41, 42 such that the first and second side panels 10, 40 extend substantially parallel to each other and in spaced relation ship to each other, the first and third end panels 20, 24 are substantially coplanar and extend substantially perpendicularly to the first and second side walls 10, 40 to form a first end wall 220, and the second and fourth end panels 30, 34 are substantially coplanar and extend substantially perpendicularly to the first and second side walls 10, 40 to form a second end wall 230.

As a result of the folding operation illustrated in FIG. 7, the handle 250 and the end closure flaps 120, 126, 130, 136 extend substantially perpendicularly to the first and second end walls 220, 230 and substantially parallel to the first and second side panels 10, 40. The first and third end closure flaps 120, 126 form a first end support wall 222 supporting the first end wall 220 and the first end of the handle 250, and the second and fourth end closure flaps 230, 236 form a second end support wall 232 supporting the second end wall 230 and the second end of the handle 250. Additionally, the end reinforcement flap 140 extends adjacent the second end panel 30 and the second end closure flap 130, thereby reinforcing the second end wall 230 and the second end support wall 232.

In the illustrated embodiment, upon folding the blank 1 as illustrated in FIG. 7, the first divider flap segment 82, which is attached to the first end closure flap 120, and the fifth divider flap segment 98, which is attached to the first divider flap segment 82 and the second end closure flap 130, are substantially coplanar with the first and second end closure flaps 120, 130. The second divider flap segment 86 folds with respect to the first divider flap segment 82 along the fold lines 83, 84 and folds with respect to the third divider flap segment 90 along the fold line 87, such that the second divider flap segment 86 extends substantially perpendicularly to the first divider flap segment 82 and the first side panel 10. The fourth divider flap segment 94 folds with respect to the fifth divider flap segment 98 along the fold lines 95, 96 and folds with respect to the third divider flap segment 90 along the fold line 91, such that the fourth divider flap segment 94 extends substantially perpendicularly to the fifth divider flap segment 98 and the first side panel 10. The seventh divider flap segment 106 folds with respect to the sixth divider flap segment 102 along the fold lines 103, 104 and pivots with respect to the eighth divider flap segment 110 along the fold line 107, such that the seventh divider flap segment 106 extends substantially perpendicularly to the sixth divider flap segment 102 and the second side panel 40. The ninth divider flap segment 114 folds with respect to the tenth divider flap segment 118 along the fold lines 115, 116 and folds with respect to the eighth divider flap segment 110 along the fold line 111, such that the ninth divider flap segment 114 extends substantially perpendicularly to the tenth divider flap segment 118 and the second side panel 40.

Figure 10:
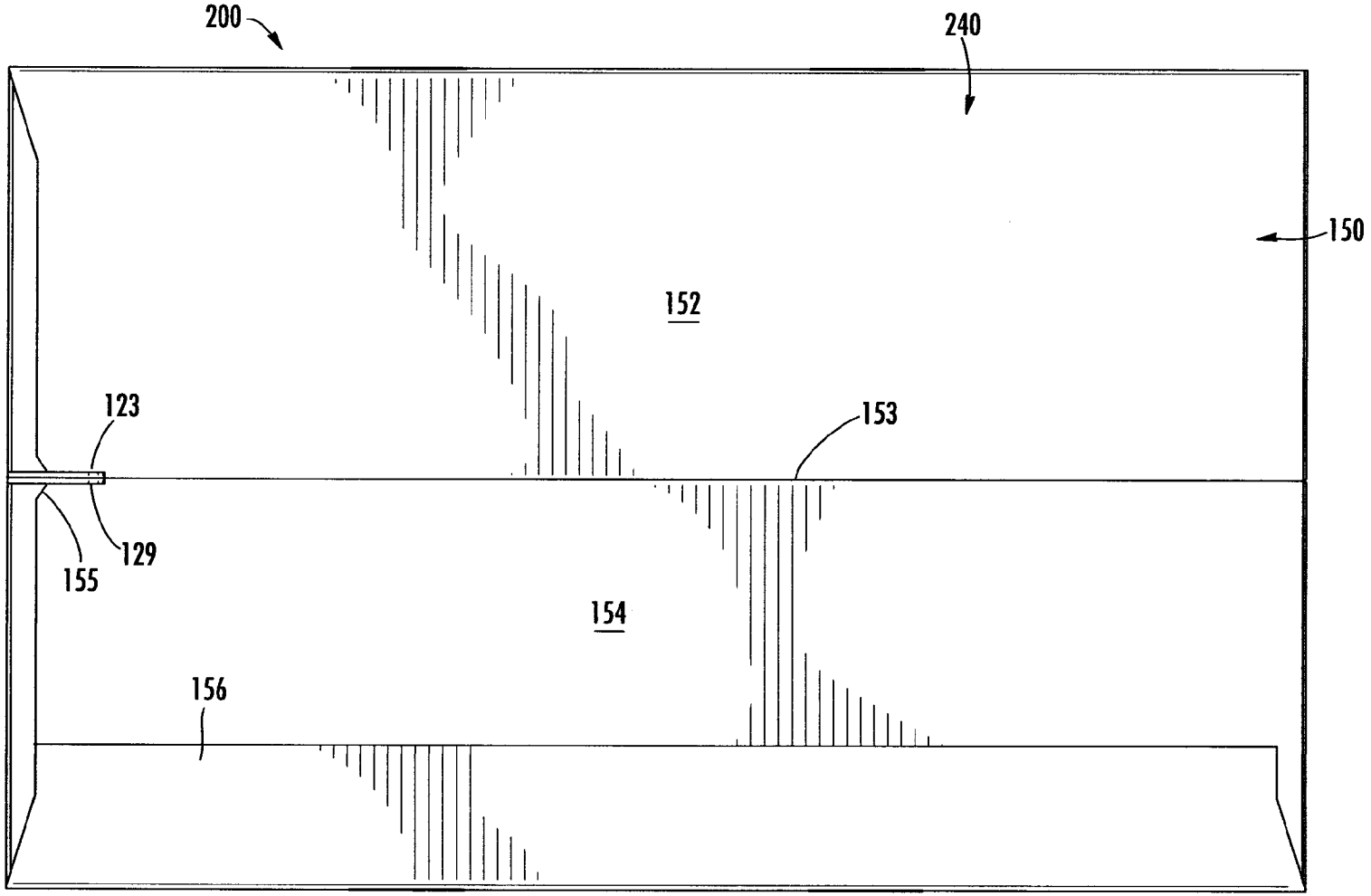
FIG. 10 is a bottom view of the carrier.

Next, the bottom closure flap 156 can be folded along the fold line 46 and the bottom flap 150 can be folded along the fold line 16, overlapping the bottom closure flap 156, such that the bottom flap 150 and the bottom closure flap 156 extend substantially perpendicularly to the side panels 10, 40 and the end walls 220, 230 (FIG. 10). The notch 155 can be positioned under the tabs 123, 129 in locking engagement with the tabs 123, 129, which are now positioned adjacent each other as a result of the folding of the first and third end closure flaps 120, 126. The second bottom flap section 154 can be adhesively or otherwise attached to the bottom closure flap 156. Thus, the bottom flap 150 and the bottom closure flap 156 form a bottom wall 240 substantially closing a bottom of the structure.

Figure 8:
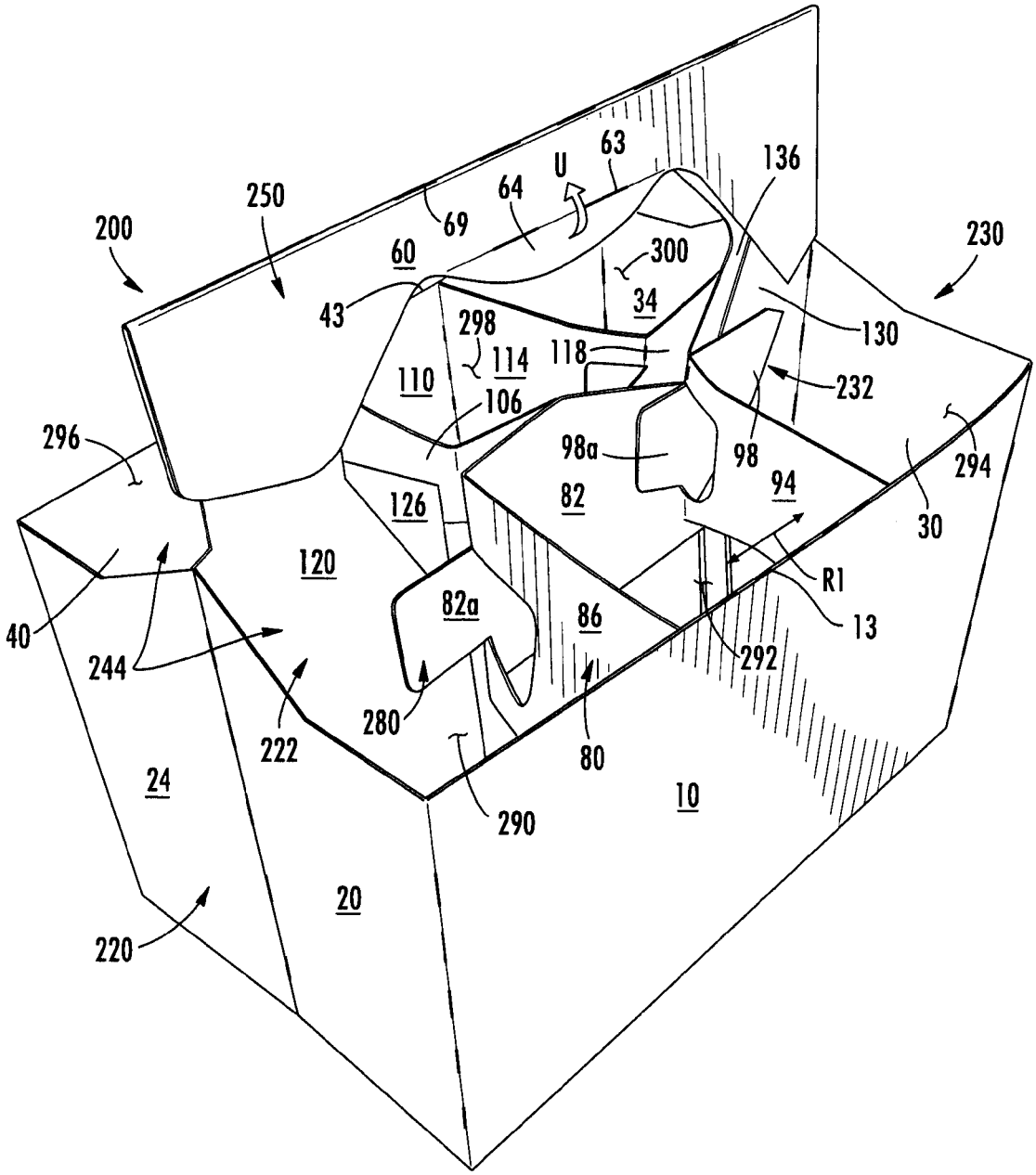
FIGS. 8 and 9 are perspective views of the erected carrier.
Figure 9:
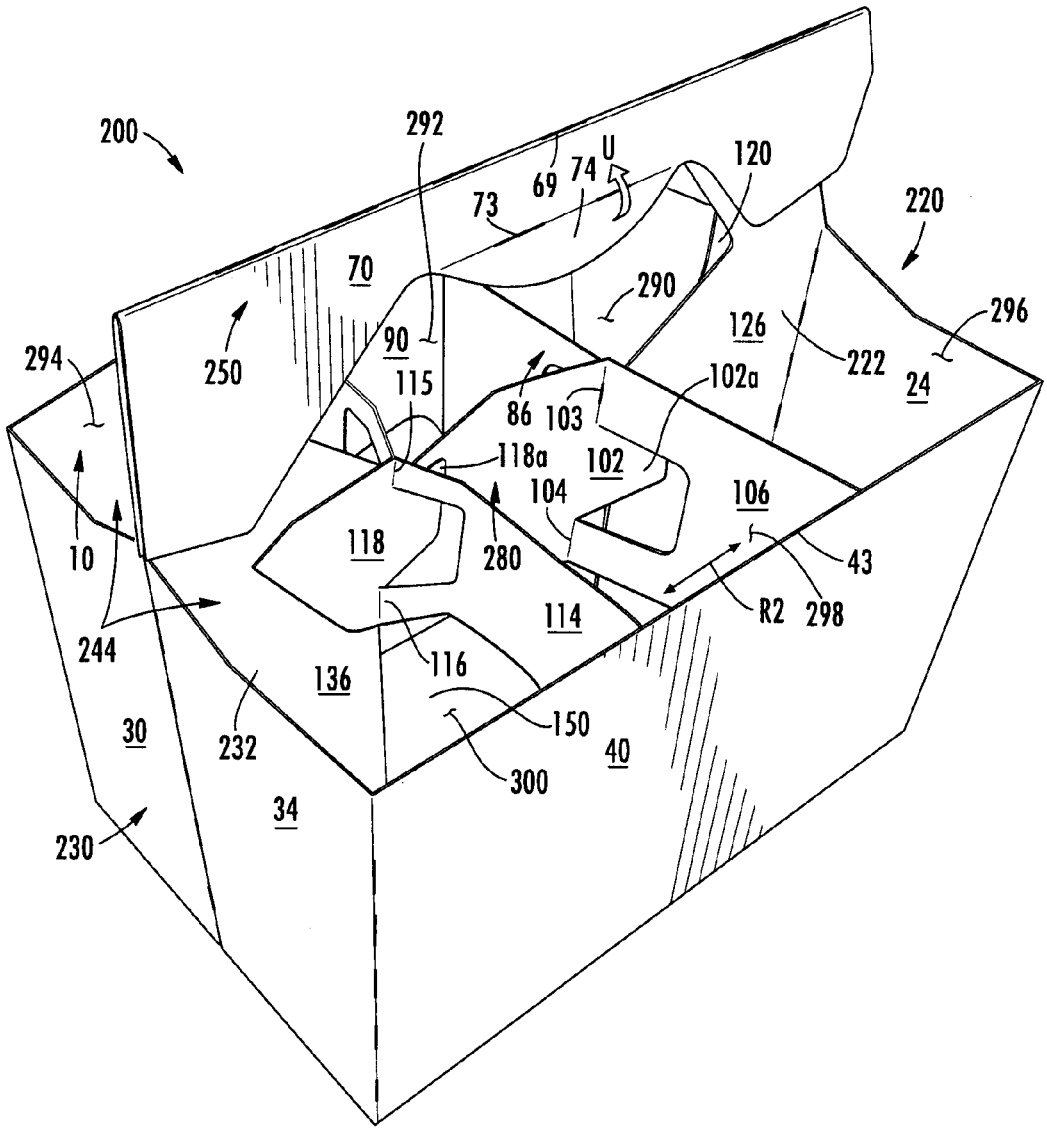

Upon completing the exemplary process described above, the carrier 200 is formed as shown in FIGS. 8-11. As illustrated in FIGS. 8 and 9, the carrier 200 includes a first side wall formed by the first side panel 10 and a second side wall formed by the second side panel 40 and extending substantially parallel to the first side wall 10 in spaced relationship thereto. The carrier 200 includes the first end wall 220 the second end wall 230 positioned opposite the first end wall 220, with both of the end walls 220, 230 extending substantially perpendicularly to the first and second side walls 10, 40. The carrier 200 further includes the bottom panel 240 (FIG. 10) extending substantially perpendicularly to the side panels 10, 40 and the end panels 220, 230. An open top 244 is formed above the side panels 10, 40 and the end panels 220, 230. The end support walls 222, 232 extend inwardly from the end walls, 220, 230, respectively, and above the open top 244, substantially perpendicularly to the end walls 220, 230 and substantially parallel to the side walls 10, 40. The end support walls 222, 232 are positioned approximately half-way between the first and second side walls 10, 40. The handle 250 is positioned approximately half-way between the first and second side walls 10, 40 and extends from the first end support wall 222 to the second end support wall 232, substantially parallel to the side panels 10, 40 and above the open top 244.

As shown in FIGS. 8 and 9, the first and second end support walls 222, 232, and the first, fifth, sixth and tenth divider flap segments 82, 98, 102, 118 are interconnected and configured to form a central divider wall 280 extending between the first and second end walls 220, 230, substantially perpendicularly to the end walls 220, 230 and substantially parallel to the first and second side walls 10, 40. The second and fourth divider flap segments 86, 94 form transverse divider walls extending between the first side wall 10 and the central divider wall 280, substantially perpendicularly to the first side wall 10 and the central divider wall 280. The seventh and ninth divider flap segments 106, 114 form transverse divider walls extending between the second side wall 40 and the central divider wall 280, substantially perpendicularly to the second side wall 40 and the central divider wall 280.

In the illustrated embodiment, the central divider wall 280, the transverse divider walls 86, 94, the end panel 20 in the first end wall 220, the first side panel 10, the end panel 30 in the second end wall 230 and the bottom panel 240 together define a first row R1 of container compartments 290, 292, 294 for holding containers C (FIG. 11) on a front side or first side of the carrier 200. Similarly, the central divider wall 280, the transverse divider walls 106, 114, the end panel 24 in the first end wall 220, the second side panel 40, the end panel 34 in the second end wall 230 and the bottom panel 240 together define a second row R2 of container compartments 296, 298, 300 for holding containers C (FIG. 11) on a rear side or second side of the carrier 200.

It can be understood from FIGS. 8-11 and the associated portions of the description that the carrier 200 contains six container compartments 290, 292, 294, 296, 298, 300 arranged in a 2×3 configuration, and is configured to be carried by a user grasping the handle 250. As shown in FIGS. 8 and 9, the grip flaps 64, 74 can be folded upwardly in the direction U along the respective fold lines 63, 73 to extend transversely to the handle flap sections 60, 70, and thereby provide an enlarged surface area for comfortably grasping the handle 250.

Figure 11:
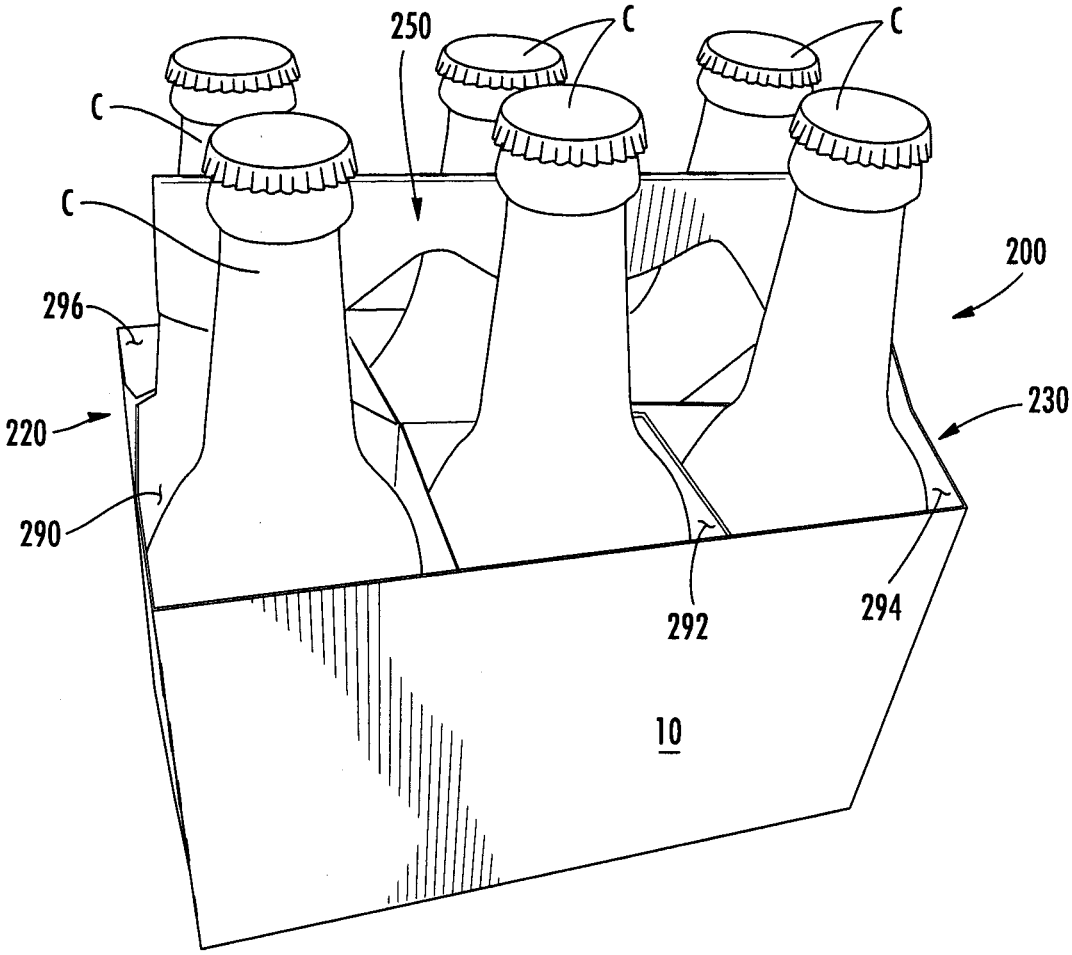
FIG. 11 is a perspective view of the carrier with containers.

As shown in FIG. 11, the central divider wall provides a central barrier that prevents or limits contact between containers C in the first row R1 and opposing containers C in the second row R2. By limiting contact between containers C in the opposing rows R1, R2, container damage and breakage is less likely, which reduces the likelihood that product contained in the containers C will be wasted during handling of the carrier 200. The configuration of the carrier 200 achieves improved protection of containers while keeping the weight of the carton low.

Although the embodiment shown and described herein includes six container compartments 290, 292, 294, 296, 298, 300 arranged in a 2×3 configuration, it should be understood that modifications are possible to provide more or fewer compartments. For example, each row R1, R2 can be configured to form any number of container compartments by changing the number of divider flaps and/or divider flap segments, and scaling the size of the blank 1 appropriately, based on the number and type of containers to be contained in the carton.

In general, the blank may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carrier for holding a plurality of containers, the carrier comprising:

a plurality of panels that extend at least partially around an interior of the carrier, the plurality of panels comprising at least one bottom panel, a first side panel, a second side panel, and at least two end panels;

at least one divider flap comprising a longitudinal segment foldably connected to at least the first side wall or the second side wall, at least a first transverse segment and a second transverse segment each foldably connected to the longitudinal segment along a respective first fold line and second fold line, and at least a first end segment and a second end segment foldably connected to the respective first transverse segment and second transverse segment along a respective third fold line and fourth fold line, wherein the second end segment is at least partially in face-to-face contact with the first end segment;

a central divider wall dividing the interior of the carrier into a front portion and a rear portion, the central divider wall comprising at least the first end segment and the second end segment of the at least one divider flap; and a handle attached to the central divider wall.

2. The carrier of claim 1, wherein the central divider wall further comprises at least two end closure flaps each foldably connected to a respective one of the at least two end panels, and wherein at least a portion of at least one of the first end segment and the second end segment of the at least one divider flap is attached to at least one end closure flap of the at least two end closure flaps.

3. The carrier of claim 2, wherein at least a portion of the first end segment of the at least one divider flap is attached to at least a first end closure flap of the at least two end closure flaps, and at least a portion of the second end segment of the at least one divider flap is attached to at least a second end closure flap of the at least two end closure flaps.

4. The carrier of claim 3, wherein the first end segment comprises a first tab at least partially defined by a cut line extending between the first tab and the first transverse segment, at least a portion of the first tab being attached in face-to-face contact with the first end closure flap.

5. The carrier of claim 4, wherein the second end segment comprises a second tab at least partially defined by a cut line extending between the second tab and the second transverse segment, at least a portion of the second tab being attached to the first end segment.

6. The carrier of claim 5, wherein the at least one divider flap comprises a first divider flap and a second divider flap, the longitudinal segment of the first divider flap being foldably connected to the first side panel, the longitudinal segment of the second divider flap being foldably connected to the second side panel, the first and second transverse segments of the first divider flap forming a plurality of front container compartments in the front portion of the carrier, and the first and second transverse segments of the second divider flap forming a plurality of rear container compartments in the rear portion of the carrier.

7. The carrier of claim 6, wherein the first end segment of the first divider flap is at least partially in face-to-face contact with the first end segment of the second divider flap.

8. The carrier of claim 6, wherein the central divider wall further comprises a third end closure flap foldably connected to at least the first end closure flap and at least partially in face-to-face contact with the first end closure flap and a fourth end closure flap foldably connected to at least the second end closure flap and at least partially in face-to-face contact with the second end closure flap, at least a portion of the first end segment of the second divider flap being attached to the third end closure flap, and at least a portion of the second end segment of the second divider flap being attached to the fourth end closure flap.

9. The carrier of claim 8, wherein the handle comprises a first handle flap foldably connected to the second end closure flap and attached to the first end closure flap and a second handle flap foldably connected to the fourth end closure flap and attached to the first end closure flap.

10. The carrier of claim 2, wherein the at least two end panels comprise at least one front end panel foldably connected to the first side panel and at least one rear end panel foldably connected to the second side panel, and wherein the at least two end closure flaps comprise at least one front end closure flap foldably connected to the at least one front end panel and at least one rear end closure flap foldably connected to the at least one rear end panel.

11. The carrier of claim 10, wherein the at least one front end closure flap is foldably connected to the at least one rear end closure flap along a longitudinal fold line, and the at least one front end closure flap is at least partially in face-to-face contact with the at least one rear end closure flap.

12. The carrier of claim 11, wherein each of the at least one front end closure flap and at least one rear end closure flap comprises a longitudinally extending portion foldably connected at the longitudinal fold line for reinforcing the handle.

13. The carrier of claim 11, wherein the at least one front end panel comprises a first front end panel and a second front end panel, the at least one front end closure flap comprises a first front end closure flap and a second front end closure flap, the at least one rear end panel comprises a first rear end panel and a second rear end panel, and the at least one rear end closure flap comprises a first rear end closure flap and a second rear end closure flap, the first front end panel and the first rear end panel forming a first end wall, the first front end closure flap and the first rear end closure flap forming a first end support wall, the second front end panel and the second rear end panel forming a second end wall, and the second front end closure flap and the second rear end closure flap forming a second end support wall.

14. The carrier of claim 1, wherein the at least one divider flap comprises a first divider flap and a second divider flap, the longitudinal segment of the first divider flap being foldably connected to the first side panel, and the longitudinal segment of the second divider flap being foldably connected to the second side panel.

15. The carrier of claim 14, wherein the at least two end panels comprise at least one front end panel foldably connected to the first side panel and at least one rear end panel foldably connected to the second side panel, and wherein the central divider wall further comprises at least one front end closure flap foldably connected to the at least one front end panel and at least one rear end closure flap foldably connected to the at least one rear end panel.

16. The carrier of claim 15, wherein at least a portion of at least one of the first end segment and the second end segment of the first divider flap is affixed to the at least one front end closure flap, and at least a portion of at least one of the first end segment and the second end segment of the second divider flap is affixed to the at least one rear end closure flap.

17. The carrier of claim 16, wherein the at least one front end panel comprises a first front end panel and a second front end panel, and the at least one front end closure flap comprises a first front end closure flap and a second front end closure flap.

18. The carrier of claim 17, wherein the first end segment comprises a first tab at least partially defined by a cut line extending between the first tab and the first transverse segment, at least a portion of the first tab being affixed in face-to-face contact with the first front end closure flap, and wherein the second end segment comprises a second tab at least partially defined by a cut line extending between the second tab and the second transverse segment, at least a portion of the second tab being affixed to the first end segment.

19. The carrier of claim 17, wherein the at least one rear end panel comprises a first rear end panel and a second rear end panel, and the at least one rear end closure flap comprises a first rear end closure flap and a second rear end closure flap.

20. The carrier of claim 19, wherein at least a portion of the first end segment of the first divider flap is affixed in face-to-face contact with the first front end closure flap, at least a portion of the second end segment of the first divider flap is affixed in face-to-face contact with the second front end closure flap, at least a portion of the first end segment of the second divider flap is affixed in face-to-face contact with the first rear end closure flap, and at least a portion of the second end segment of the second divider flap is affixed in face-to-face contact with the second rear end closure flap.

21. The carrier of claim 19, wherein the first end segment of the first divider flap is at least partially in face-to-face contact with the first end segment of the second divider flap.

22. The carrier of claim 19, wherein at least a portion of the handle is affixed to at least the first front end closure flap, and wherein the handle is foldably connected to at least second front end closure flap.

23. A blank for forming a carrier for holding a plurality of containers, the blank comprising:

a plurality of panels comprising at least one bottom panel, a first side panel, a second side panel, and at least two end panels;

at least one divider flap comprising a longitudinal segment foldably connected to at least the first side wall or the second side wall, at least a first transverse segment and a second transverse segment each foldably connected to the longitudinal segment along a respective first fold line and second fold line, and at least a first end segment and a second end segment foldably connected to the respective first transverse segment and second transverse segment along a respective third fold line and fourth fold line, wherein the second end segment is for being disposed at least partially in face-to-face contact with the first end segment when the carrier is formed from the blank;

a handle comprising at least one handle flap at least partially defined by a cut line extending between the at least one handle flap and at least a portion of the at least one divider flap;

wherein the first end segment and the second end segment of the at least one divider flap are for forming at least a portion of a central divider wall for dividing the interior of the carrier formed from the blank into a front portion and a rear portion.

24. The blank of claim 23, wherein each of the first transverse segment and the second transverse segment of the at least one divider flap is for being folded with respect to the longitudinal segment so that the first transverse segment and the second transverse segment extend at least partially across the front portion or the rear portion of the carrier formed from the blank in a transverse direction.

25. The blank of claim 23, further comprising at least two end closure flaps each foldably connected to a respective one of the at least two end panels, wherein at least a portion of at least one of the first end segment and the second end segment of the at least one divider flap is for being attached to at least one end closure flap of the at least two end closure flaps.

26. The blank of claim 25, wherein the first end segment comprises a first tab at least partially defined by a cut line extending between the first tab and the first transverse segment, at least a portion of the first tab for being attached in face-to-face contact with a first end closure flap of the at least two end closure flaps.

27. The blank of claim 26, wherein the second end segment comprises a second tab at least partially defined by a cut line extending between the second tab and the second transverse segment, at least a portion of the second tab for being attached to the first end segment.

28. The blank of claim 27, wherein the at least one divider flap comprises a first divider flap and a second divider flap, the longitudinal segment of the first divider flap being foldably connected to the first side panel, the longitudinal segment of the second divider flap being foldably connected to the second side panel, the first and second transverse segments of the first divider flap being for extending transversely across the front portion of the carrier formed from the blank for forming a plurality of front container compartments, and the first and second transverse segments of the second divider flap being for extending transversely across the rear portion of the carrier formed from the blank for forming a plurality of rear container compartments.

29. The blank of claim 28, wherein the at least two end panels comprise a first end panel and a second end panel respectively foldably connected to the first side panel and a third end panel and a fourth end panel respectively foldably connected to the second side panel, the first end closure flap being foldably connected to at least the first end panel, and the second end closure flap being foldably connected to at least the second end panel.

30. The blank of claim 29, further comprising a third end closure flap foldably connected to at least the first end closure flap and the third end panel and a fourth end closure flap foldably connected to at least the second end closure flap and the fourth end panel.

31. The blank of claim 30, wherein the handle comprises a first handle flap foldably connected to the second end closure flap along a first lateral fold line and a second handle flap foldably connected to the fourth end closure flap along a second lateral fold line.

32. The blank of claim 31, wherein the first handle flap is connected to the second handle flap along a central longitudinal fold line.

33. The blank of claim 32, wherein at least a portion of each of the longitudinal segment and the second transverse segment of the first divider flap extends at least from an edge of the first handle flap and the first side panel in the blank, and at least a portion of each of the longitudinal segment and the second transverse segment of the second divider flap extends at least from an edge of the second handle flap and the second side panel in the blank.

34. The blank of claim 33, wherein at least a portion of the first transverse segment of the first divider flap extends between an edge of the first side panel and the first transverse segment of the second divider flap in the blank, and at least a portion of the first transverse segment of the second divider flap extends between an edge of the second side panel and the first transverse segment of the first divider flap in the blank.

35. The blank of claim 33, wherein at least a portion of the second end segment of the first divider flap extends at least from the edge of the first handle flap to an edge of the second end panel in the blank, and at least a portion of the second end segment of the second divider flap extends at least from the edge of the second handle flap to an edge of the fourth end panel in the blank.

36. The blank of claim 33, wherein at least a portion of the first end segment of the first divider flap extends adjacent at least the first end panel and the first end closure flap in the blank, and at least a portion of the first end segment of the second divider flap extends adjacent at least the third end panel, the third end closure flap, and the first end segment of the first divider flap in the blank.

37. The blank of claim 36, wherein at least a portion of the first transverse segment of the first divider flap extends adjacent at least the first side panel in the blank, and at least a portion of the first transverse segment of the second divider flap extends adjacent at least the second side panel and the first transverse segment of the first divider flap in the blank.

38. The blank of claim 23, wherein at least a portion of the longitudinal segment of the at least one divider flap extends at least from an edge of the handle and the first side panel or the second side panel in the blank.

39. The blank of claim 38, wherein the second transverse segment extends at least from an edge of the handle and the first or second side panel in the blank, and the first transverse segment is at least partially defined by a longitudinal cut line extending between the first transverse segment and the first or second side panel and a transverse cut line extending between the first transverse segment and at least a portion of the handle in the blank.

40. The blank of claim 39, wherein the second end segment extends at least from an edge of the handle and at least one of the at least two end panels, and the first end segment is at least partially defined by a cut line extending between the first end segment and at least one of the at least two end panels.

41. The blank of claim 40, wherein the first end segment of the at least one divider flap comprises a first tab at least partially defined by a first generally U-shaped cut line extending between the first end segment and the first transverse segment, and the second end segment of the at least one divider flap comprises a second tab at least partially defined by a second generally U-shaped cut line extending between the second end segment and the second transverse segment.

42. A method of forming a carrier from a blank, the method comprising:

obtaining a blank comprising a plurality of panels comprising at least one bottom panel, a first side panel, a second side panel, and at least two end panels, at least one divider flap comprising a longitudinal segment foldably connected to at least the first side wall or the second side wall, at least a first transverse segment and a second transverse segment each foldably connected to the longitudinal segment along a respective first fold line and second fold line, and at least a first end segment and a second end segment foldably connected to the respective first transverse segment and second transverse segment along a respective third fold line and fourth fold line, and a handle;

folding the at least one divider flap to be at least partially in face-to-face contact with at least a portion of at least the first side panel or the second side panel, and folding the first transverse segment and the first end segment so that the first end segment is at least partially in face-to-face contact with the second end segment;

folding the blank along a longitudinal centerline so that the first end segment and the second end segment of the at least one divider flap are disposed between the first side wall and the second side wall, the first end segment and the second end segment forming at least a portion of a central divider wall, forming an interior of the carrier by extending the at least two end panels away from the central divider wall so that the interior of the carrier is divided into a front portion and a rear portion by the central divider wall;

wherein the forming the interior of the carrier causes the first transverse segment and the second transverse segment of the at least one divider flap to pivot with respect to the longitudinal segment and the respective first end segment and second end segment so that the first transverse segment and the second transverse segment extend generally perpendicularly to the central divider wall and extends at least partially to the first side panel or the second side panel.

43. The method of claim 42, wherein the at least two end panels comprises a first end panel and a second end panel respectively foldably connected to the first side panel, and the blank further comprises a first end closure flap and a second end closure flap each foldably connected to the respective first and second end panels.

44. The method of claim 43, further comprising folding the second end closure flap to be at least partially in face-to-face contact with the second end panel and folding the first end panel so that the first end panel and the first end closure flap are each at least partially in face-to-face contact with the first side panel.

45. The method of claim 44, wherein, after the folding the first transverse segment and the first end segment, the first transverse segment is at least partially in face-to-face contact with at least the longitudinal segment and the first end segment is at least partially in face-to-face contact with at least the second transverse segment.

46. The method of claim 45, wherein the folding the second end closure flap further comprises affixing at least a portion of the second end segment of the at least one divider flap in face-to-face contact with the second end closure flap, and the folding the first end panel further comprises affixing at least a portion of the first end segment in face-to-face contact with the first end closure flap.

47. The method of claim 46, wherein the folding the first transverse segment and the first end segment further comprises affixing at least a portion of the second end segment to the first end segment.

48. The method of claim 47, wherein the at least one divider flap comprises a first divider flap and a second divider flap, and the folding the blank along the longitudinal centerline comprises affixing the first end segment of the first divider flap at least partially in face-to-face contact with the first end segment of the second divider flap.

49. The method of claim 43, wherein the at least two end panels further comprise a third end panel and a fourth end panel respectively foldably connected to the second side panel, and the blank further comprises a third end closure flap and a fourth end closure flap each foldably connected to the respective first and second end panels.

50. The method of claim 49, wherein the first end closure flap is connected to the third end closure flap along the longitudinal centerline, and the second end closure flap is connected to the fourth end closure flap along the longitudinal centerline, the folding the blank along the longitudinal centerline further comprising positioning the first end closure flap at least partially in face-to-face contact with the third end closure flap and positioning the second end closure flap at least partially in face-to-face contact with the fourth end closure flap.

51. The method of claim 42, wherein the handle comprises a first handle flap foldably connected to a second handle flap along the longitudinal centerline.

* * * * *